United States Patent [19]

Elliott

[11] Patent Number: 4,735,384

[45] Date of Patent: Apr. 5, 1988

[54] APPARATUS FOR DETECTING THE DISTANCE BETWEEN A RAIL VEHICLE AND A REMOTE OBSTACLE ON THE RAIL

[76] Inventor: Willard Elliott, 202-1710 Taylor Avenue, Winnipeg, Manitoba, Canada, R3N 0N9

[21] Appl. No.: 890,513

[22] Filed: Jul. 30, 1986

[30] Foreign Application Priority Data

Jun. 4, 1986 [CA] Canada ..... 510789

[51] Int. Cl.[4] ..... B61L 3/22

[52] U.S. Cl. ..... 246/167 D; 246/167 R

[58] Field of Search ..... 340/167 D, 167 R, 65, 340/64, 73, 36, 38, 44, 37; 246/34 A, 34 R, 182 R, 182 A

[56] References Cited

U.S. PATENT DOCUMENTS

| | | | |
|---|---|---|---|
| 797,191 | 8/1905 | Foreman | 246/65 |
| 1,413,871 | 4/1922 | Perkins | 246/167 D |
| 1,550,538 | 8/1925 | Graybill | 246/64 |
| 3,079,496 | 2/1963 | Bogel et al. | 246/167 R |
| 3,365,572 | 1/1968 | Strauss | 246/167 D |
| 3,836,770 | 9/1974 | Helmeke et al. | 246/167 R |
| 3,902,689 | 9/1975 | Hermann et al. | 246/63 R |
| 3,913,874 | 10/1975 | Barpal | 246/182 R |
| 3,973,746 | 8/1976 | Ball | 246/187 B |
| 4,014,503 | 3/1977 | Raimer | 246/34 R |
| 4,023,754 | 5/1977 | Wallgard et al. | 246/63 R |
| 4,085,913 | 4/1978 | Chang | 246/63 A |
| 4,117,529 | 9/1978 | Stark et al. | 246/34 R |
| 4,181,943 | 1/1986 | Mercer, Sr. et al. | 246/182 B |
| 4,274,611 | 6/1981 | Salmon | 246/34 R |
| 4,389,033 | 6/1983 | Hardman | 246/37 |
| 4,550,889 | 11/1985 | Emmel | 246/28 R |

FOREIGN PATENT DOCUMENTS

| | | | |
|---|---|---|---|
| 8826201 | 10/1969 | Canada . | |
| 2405556 | 8/1975 | Fed. Rep. of Germany . | |
| 2548417 | 5/1977 | Fed. Rep. of Germany . | |
| 2378663 | 8/1978 | France . | |
| 0928968 | 6/1963 | United Kingdom | 246/167 D |

*Primary Examiner*—John W. Caldwell, Sr.
*Assistant Examiner*—Alvin Oberley
*Attorney, Agent, or Firm*—Ade Stanley G.; Adrian D. Battison; Murray E. Thrift

[57] ABSTRACT

A rail vehicle of a type for running on a pair of parallel rails has an apparatus for detecting the distance between it and a forward remote vehicle, for detecting the speed of the forward remote vehicle and for detecting discontinuities in the track. This is achieved by a first electrical contact for engaging one of the rails which applies a voltage between the contact and the first set of wheels of the vehicle which generate a short across the two rails. The spacing between the contact and the first set of wheels is such that a current runs from the contact forwardly of the vehicle to a short circuit across the rails generated by the next adjacent remote vehicle and back to a second electrical contact on the vehicle contacting the other rail. The magnitude of the voltage difference between the second contact and the first set of wheels is then measured to provide an indication of the distance between the vehicle and the next adjacent remote vehicle. The voltage at the first contact is provided in pulses at a frequency dependent upon the velocity of the vehicle and is detected in pulses at the second contact. The second contact also can detect pulses from the remote vehicle and can therefore detect its velocity. A discontinuity in the track can be detected by a rapid decrease in voltage at the second contact.

17 Claims, 1 Drawing Sheet

APPARATUS FOR DETECTING THE DISTANCE BETWEEN A RAIL VEHICLE AND A REMOTE OBSTACLE ON THE RAIL

BACKGROUND OF THE INVENTION

This invention relates to a rail vehicle of the type for moving along a pair of parallel rails and including a plurality of pairs of wheels with each wheel of each pair arranged to engage a respective one of the rails and particularly to an apparatus in such a vehicle for detecting the distance between the vehicle and an remote obstacle on the rail.

In much of Canada and similar large countries there are many miles of rail track which is of the conventional simple double rail with no accompanying electrical wires or the like. In many cases also the rail is of a single track, that is traffic in both directions uses the same track with occasional double track portions for allowing passing. In such circumstances it is particularly important to ensure that the rail vehicles are properly spaced and that there is no possibility of such vehicles approaching one another in opposite directions on the same length of track.

Such techniques are normally carried out by separate control systems which monitor the position of trains on the track and which provide necessary signalling alongside the track to inform the engineer whether he is allowed to move forward along the track.

However, there remains a need, to supplement existing systems in case of failure, for a more direct indication within the vehicle as to whether there are obstacles on the track and particularly other vehicles or trains and the distance from those vehicles.

A number of proposals have been made for determining and controlling the distance between such rail vehicles but in most cases these require additional complex equipment separate from the vehicle on the track. In some cases the track or an adjacent conductor carries transmitted signals which are communicated to the vehicle and assist in determining the position of the vehicle relative to other such vehicles.

U.S. Pat. No. 4,133,505 (Bongiorno) discloses an arrangement in which each vehicle has a device for generating a current which is applied by a pantagraph to an overhead wire. The current is then withdrawn from the wire by the next adjacent vehicle so that the magnitude of the current is dependent upon the resistance of the overhead wire and thus the length of wire between each vehicle and the next.

However this device has a number of significant disadvantages. Firstly it requires a separate additional wire to be installed along the track. Secondly it requires a number of diodes along the wire to prevent current generated by a third vehicle from interfering with the proper measurement. Thirdly it requires each vehicle on the track to be equipped with the device. Fourthly it is incapable of detecting any obstacles other than another similarly equipped vehicle.

The above patented device therefore has apparently received little or no success and certainly has not been adopted in Canada where the large lengths of track already existing without the additional necessary wires effectively prevent the economic acceptance of such a device.

It is one object of the present invention, therefore, to provide an apparatus for detecting the distance between the vehicle and a remote obstacle which does not require the addition of further trackside equipment and merely requires the positioning of a suitable apparatus within the vehicle concerned.

According to the invention, therefore, there is provided a rail vehicle for moving along a pair of parallel rails comprising a plurality of pairs of wheels arranged such that each one of each pair of wheels engages a respective one of the rails, at least one pair of the wheels being electrically interconnected so as to provide a short circuit across the rails and an apparatus for detecting the distance between the vehicle and a remote obstacle on the rails, the obstacle being of a type which varies the electrical conductivity across the rails, the apparatus including first contact means for engaging one of the rails at a position spaced from a respective wheel of said one pair of wheels, second contact means for engaging the other of the rails at a position spaced from the other wheel of said one pair of wheels, voltage generation means for applying a predetermined voltage difference between said first contact means and said one pair of wheels so as to generate a current in said one rail flowing from said first contact to said one pair of wheels and from said first contact along said one of said rails away from said one pair of wheels towards said obstacle, means for detecting the voltage difference between said second contact means and said one pair of wheels caused by current flowing from said obstacle to said one pair of wheels and means for displaying a signal generated in dependence upon the magnitude of said detected voltage difference so as to provide an indication of the distance between said vehicle and said obstacle.

The invention therefore uses the short circuit across the rails which is caused by the wheels of the next adjacent remote vehicle to generate a current from the first contact along the first rail to the short circuit back along the second rail to the second contact. The present inventor has realized that such a voltage can be applied to the rail despite the presence of a second short circuit across the rails provided by the next adjacent wheels of the vehicle on which the apparatus is positioned. The voltage applied at the first contact can be very low of the order of 0.1 volts which will avoid high currents in the rail portion between the first contact and the next adjacent wheels of the vehicle while generating a sufficient voltage at the second contact to provide a measurable voltage even over relatively long lengths of track between the vehicle and the remote vehicle.

Experiments show that detection of the next adjacent train can occur in good weather conditions at a distance of up to 100 miles.

The voltage can be applied to the rail by the first contact periodically and at a a frequency dependent upon the velocity of the vehicle. In cases where two such vehicles are equipped with the apparatus, the second vehicle can detect the pulses issued from the first vehicle and thus can measure its velocity in view of the known issued frequency.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

The FIGURE is a schematic plan view of a vehicle according to the invention mounted upon a rail track.

In the drawings like characters of reference indicate corresponding parts in the different figures.

DETAILED DESCRIPTION

Figure 1:
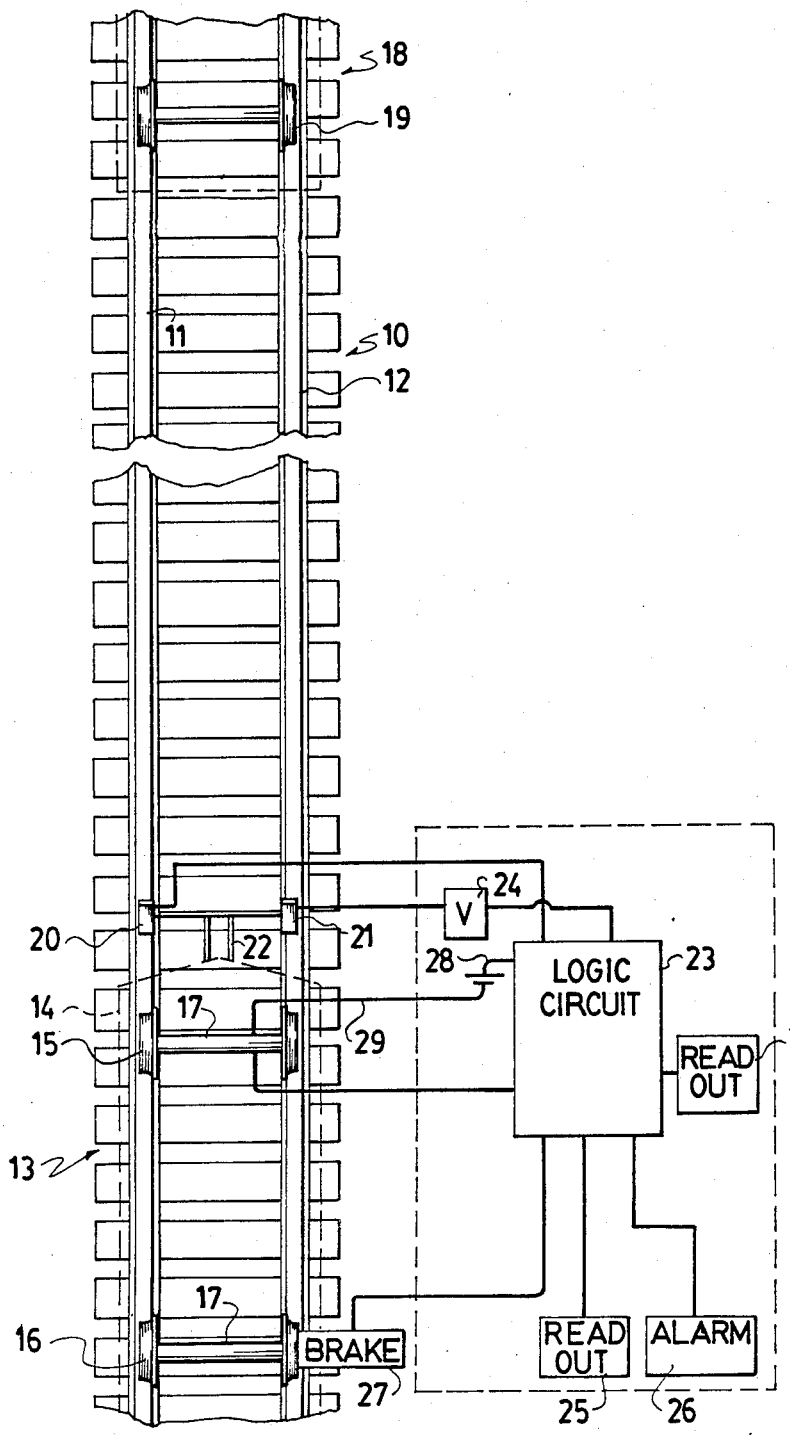

In the drawing, a rail track is schematically indicated at 10 including a first rail 11 and a second rail 12 which are mounted upon conventional ties and ballast which are generally of concrete and gravel respectively. The rail system is free from any other wiring, transmitters or the like.

A first vehicle on the track is indicated at 13 and includes a vehicle body 14 mounted upon rail engaging wheels 15 and 16. Each of the wheels 15 and 16 is formed as a pair of wheels mounted upon an axle 17 so that each of the wheel pairs forms a short circuit directly across from one rail 11 to the other rail 12. It will be appreciated that in conventional rail vehicles the wheel pair 15 is formed as a single casting and thus forms a single electrical path across the rails.

A second vehicle is indicated at 18 which is some distance away from the first vehicle and similarly includes a wheel pair 19 which extends across the rails and therefore again forms a short circuit from the rail 11 to the rail 12.

The first vehicle 13 includes a first contact 20 for contacting the rail 11 and a second contact 21 for contacting the rail 12. These contacts are indicated schematically but in one embodiment they are formed by shoes which run along the track in advance of the vehicle on a support strut arrangement 22. As an alternative the contacts 20 and 21 could be formed by wheels which permanently contact each of the respective rails but are insulated one from the other.

The apparatus further includes a logic circuit 23, a microvolt meter 24, a readout display 25, a visual or audible alarm 26 and an automatic brake application device 27.

The distance between the first contact 20 and the first wheel 15 is arranged to be a significant distance which in one example may be of the order of 10 feet. The contact 21 is spaced from the wheel pair 15 on the rail 12 by a similar distance which may or may not be exactly equal to the distance between the contact 20 and the wheels 15.

A battery 28 generates a voltage for application to the rail 11 through the contact 20. The voltage is however controlled by the logic circuit as explained hereinafter. A connection 29 between the wheels 15 and the logic circuit communicates to the logic circuit the frequency of rotation of the wheels that is the velocity of the vehicle along the track. Although schematically shown as connected directly to the wheels, it will of course be appreciated that various other drive transmission parts of the vehicle rotate at a rate dependent upon the velocity of the vehicle and accordingly can be used to provide the necessary frequency information.

The logic circuit 23 is therefore designed and arranged in a manner which will be well apparent to one skilled in the art to communicate the voltage from the battery 28 to the contact 20 in pulses at a frequency dependent upon the velocity of the vehicle. In one example the pulses can be of the order of 0.01 second in period separated in time by the rate of rotation of the wheels 15 which could be up to 0.25 of a second. The voltage generated by the battery 28 is controlled to provide a voltage at the contact 20 of the order of 0.1 volts.

Experiments show that the resistance of a conventional track is about 0.1 ohms per mile. A length of ten feet of track, that is the distance between the contact 20 and the wheel 15, therefore has a resistance of $1.9\times10^{-4}$ ohms. The voltage of 0.1 volts at the contact 20 will therefore generate a current in the rail between the contact 20 and the wheel 15 of 530 amps. If generated from a 12 volt battery, the power consumed would be $66\times12=6360$ watts but is applied only for 0.01 second every 0.25 seconds this represents an average power of 255 watts. It will be appreciated of course that the battery is grounded to the vehicle which in turn is grounded of course to the wheels 15.

The voltage at the contact 20 also generates a current in the rail 11 forwardly of the vehicle toward the remote vehicle 18. This current is shorted across from the rail 11 to the rail 12 by the wheels 19 of the vehicle 18 and thus generates a current also in the track 12. This current will generate a voltage drop between the second contact 21 and the wheels 15 in the rail 12 which voltage drop is measured by the volt meter 24. The volt meter 24 is arranged to measure voltages down to of the order of 1 microvolt. The volt meter 24 continually samples the voltage generated at the contact 21.

The logic circuit 23 is arranged to sample the voltage from the volt meter 24 at periods dependent upon the rate of transmission of the pulses from the contact 20. Preferably the sampling is delayed by a period of the order of 0.005 seconds so as to measure the voltage at a maximum which may be of the order of ninety per cent of theoretical maximum to take into account the delay in increase in current caused by the inductance of the rail between the contact 20 and 21 through the short provided by the wheel 19.

The logic circuit can also determine when the voltage at the contact 21 exceeds a predetermined set voltage thus indicating that a remote vehicle on the track is within a certain distance. Initially an increase in voltage can be used to actuate the alarm 26 and subsequently if the voltage yet further increases indicating the vehicle has come closer, the brakes can be automatically applied by the device schematically indicated at 27.

It will be appreciated that moisture on the track will cause a difference in conductivity of the track in that sufficient moisture will provide conductivity between the rails along its length through a resistance which is measurable relative to track length.

In one example, which represents the worst extreme case where high levels of muddy water are present, there is a significant change in measured voltage at the contact 21 for a particular level of voltage at the contact 20. The voltage can therefore never fall below an effective minimum voltage due to the conductivity between the tracks provided by the moisture. In this example it has been found that in such highly adverse conditions the equipment would indicate the existence of another vehicle on the track at a distance of approximately 5 miles; but this of course would be a phantom and would move forwardly with the vehicle. For this reason the distance at which the alarm may operate can be set at a voltage slightly higher than this minimum in the most adverse conditions so that as soon as the voltage increases above this minimum it is known that the increase is caused by an approaching vehicle or other obstacle which changes the conductivity across the track. Similarly the brakes can be applied at a yet higher voltage. It will be appreciated that the above example describes the most extreme adverse conditions and in most cases the moisture levels will not reach the above stated condition. In all cases, however, the moisture conditions will alter the reading of the voltage for the actual distance of the remote vehicle from the vehicle. This can be compensated either by calibrating the logic circuit periodically using a short circuit across the track at a known distance or by manually setting the logic circuit in depend ence upon estimated moisture conditions.

The distance between the contacts 20 and 21 and the wheel pair 15 in one example is arranged to be approximately ten feet but it will be appreciated that this distance can be varied within limits. The limits are controlled firstly by the practical distance of support of the contacts forwardly of the wheels 15 which will significantly increase the complexity of the mechanical support device if the distance is increased; and secondly the current flow in the section of rail 15 which will increase beyond acceptable limits if the distance is significantly deceased.

As the volt meter 24 is arranged to continually detect the voltage at the contact 21, the logic circuit can extract from the measured voltage pulses which arise from another rail vehicle on the same track having effectively the same equipment as that set out in FIG. 1. The contact 21 will only receive such pulses from a vehicle where the contacts of that vehicle are positioned between the remote vehicle and the first set of grounded wheels of the remote vehicle and thus the contact 21 will only effectively receive pulses from a remote vehicle traveling towards the vehicle. The velocity of the remote vehicle can be detected by the logic circuit from the frequency of the pulses and can be displayed at the readout 30.

The logic circuit is also arranged to detect a rapid decrease in voltage at the contact 21. In the condition where the track forward of the vehicle is no longer complete as per example when the track has been washed away, the current generated by the contact 20 will no longer reach the contact 21 since there is no continuous path along the rail 11 to the next adjacent remote vehicle. In this case the voltage will decrease as the vehicle approaches the point of discontinuity in the track and will decrease at a rate greater than that which would normally be encountered in a situation where either the remote vehicle is moving away from the vehicle or where the track moisture conditions are varying. The logic circuit therefore detects a decrease in voltage at a rate greater than a predetermined set rate and then actuates the alarm 26 and subsequently the automatic brake actuator 27 in dependence upon the high rate of decrease.

In an alternative arrangement (not shown), the contact 20 can be provided as an insert in one of the wheels which is insulated from the remainder of the wheel and which provides the only contact between the wheel and the rail at one point in the rotation of the wheel thus automatically pulsing the voltage applied to the wheel once for each revolution of the wheel and timing the pulse over a short portion of the period of rotation dependent upon the angular extent of the portion. In this way the contact can be provided by the front wheel of the vehicle with the next adjacent wheel being approximately ten feet in spacing from the front wheel.

In a yet further alternative arrangement (not shown), the front wheel of the vehicle can be insulated from the vehicle so that it provides a continual contact with the rail whereupon the timing of the pulses applied to the rail can be controlled as previously described by the logic circuit.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A rail vehicle for moving along a pair of parallel rails comprising a plurality of pairs of wheels arranged such that each one of each pair of wheels engages a respective one of the rails, at least one pair of the wheels being electrically interconnected so as to provide a short circuit across the rails and an apparatus for detecting the distance between the vehicle and a remote obstacle on the rails, the obstacle being of a type which varies the electrical conductivity across the rails, the apparatus including first contact means for engaging one of the rails at a position spaced from a respective wheel of said one pair of wheels, second contact means for engaging the other of the rails at a position spaced from the other wheel of said one pair of wheels, voltage generation means for applying a predetermined voltage difference between said first contact means and said one pair of wheels so as to generate a current in said one rail flowing from said first contact to said one pair of wheels and from said first contact along said one of said rails away from said one pair of wheels towards said obstacle, said voltage generation means including means arranged to apply said voltage difference in pulses repeatedly at timed intervals for a period of time significantly shorter than the period of time between each application, means for detecting the voltage difference between said second contact means and said one pair of wheels caused by current flowing from said obstacle to said one pair of wheels said detecting means including sampling means dependant upon said timing means to sample said detected voltage difference at said timed intervals to generate a magnitude of said detected voltage difference, and means for displaying a signal generated in dependence upon the magnitude of said detected voltage difference so as to provide an indication of the distance between said vehicle and said obstacle.

2. The invention according to claim 1 wherein the detecting means is arranged to sample the voltage after a delay from the application of said voltage of a length sufficient to take into account the inductance of the rail whereby to sample said voltage of said second contact at a maximum thereof.

3. The invention according to claim 1 wherein said first contact means is attached to a wheel of said vehicle for rotation therewith whereby said voltage is applied to said rail at a frequency determined by the rate of rotation of the wheel.

4. The invention according to claim 3 wherein said wheel is a support wheel of said vehicle and wherein said first contact means is electrically insulated from said wheel and therefore from said vehicle.

5. The invention according to claim 1 wherein said first contact means is separate from the wheels of the vehicle and is presented forwardly of said vehicle so as to be spaced from forwardmost wheels of said vehicle.

6. The invention according to claim 1 wherein said voltage is applied to said first contact means in pulses with each pulse spaced from the next pulse by a period of time dependent upon the velocity of the vehicle along the rails.

7. The invention according to claim 1 wherein said first contact means is separate from the wheels of the vehicle and is presented forwardly of said vehicle so as to be spaced from forwardmost wheels of said vehicle and wherein said voltage is applied to said first contact means in pulses with each pulse spaced from the next pulse by a period of time dependent upon the velocity of the vehicle along the rails.

8. The invention according to claim 1 wherein said voltage is applied to said first contact means in pulses with each pulse spaced from the next pulse by a period of time dependent upon the velocity of the vehicle along the rails and wherein said displaying means includes means for determining the frequency of voltage pulses detected by said detecting means whereby to provide an indication of velocity of a remote vehicle including similar detecting apparatus.

9. The invention according to claim 1 wherein said first contact means is separate from the wheels of the vehicle and is presented forwardly of said vehicle so as to be spaced from forwardmost wheels of said vehicle and wherein the invention according to claim 1 wherein said voltage is applied to said first contact means in pulses with each pulse spaced from the next pulse by a period of time dependent upon the velocity of the vehicle along the rails and wherein said displaying means includes means for determining the frequency of voltage pulses detected by said detecting means whereby to provide an indication of velocity of a remote vehicle including similar detecting apparatus.

10. The invention according to claim 1 including means for providing an alarm signal in dependence upon an increase in said detected voltage above a predetermined set value.

11. The invention according to claim 1 including means for providing an alarm signal in dependence upon a decrease in said detected voltage which decrease has rate of decrease greater than a predetermined value.

12. The invention according to claim 1 including means for automatically applying brakes of the vehicle in dependence upon a detected voltage.

13. A rail vehicle for moving along a pair of parallel rails comprising a plurality of pairs of wheels arranged such that each one of each pair of wheels engages a respective one of the rails, at least one pair of the wheels being electrically interconnected so as to provide a short circuit across the rails and an apparatus for detecting the distance between the vehicle and a remote obstacle on the rails, the obstacle being of a type which varies the electrical conductivity across the rails, the apparatus including first contact means for engaging one of the rails at a position spaced from a respective wheel of said one pair of wheels, second contact means for engaging the other of the rails at a position spaced from the other wheel of said one pair of wheels, voltage generation means for applying a predetermined voltage difference between said first contact means and said one pair of wheels so as to generate a current in said one rail flowing from said first contact to said one pair of wheels and from said first contact along said one of said rails away from said one pair of wheels towards said obstacle, said voltage generation means including means arranged to apply said voltage difference in pulses repeatedly at timed intervals for a period of time significantly shorter than the period of time between each application, means for detecting the voltage difference between said second contact means and said one pair of wheels caused by current flowing from said obstacle to said one pair of wheels said detecting means including sampling means dependent upon said timing means to sample said detected voltage difference at said timed intervals to generate a magnitude of said detected voltage difference, and means for displaying a signal generated in dependence upon the magnitude of said detected voltage difference so as to provide an indication of the distance between said vehicle and said obstacle, said timing means being arranged to space each pulse from the next pulse by a period of time dependent upon the velocity of the vehicle along the rails.

14. The invention according to claim 13 wherein the detecting means is arranged to sample the voltage after a delay from the application of said voltage of a length sufficient to take into account the inductance of the rail whereby to sample said voltage of said second contact at a maximum thereof.

15. The invention according to claim 13 wherein said first contact means is attached to a wheel of said vehicle for rotation therewith whereby said voltage is applied to said rail at a frequency determined by the rate of rotation of the wheel.

16. The invention according to claim 15 wherein said wheel is a support wheel of said vehicle and wherein said first contact means is electrically insulated from said wheel and therefore from said vehicle.

17. The invention according to claim 13 wherein said first contact means is separate from the wheels of the vehicle and is presented forwardly of said vehicle so as to be spaced from forwardmost wheels of said vehicle.

* * * * *